US008109177B2

(12) United States Patent
Kembaiyan

(10) Patent No.: US 8,109,177 B2
(45) Date of Patent: Feb. 7, 2012

(54) BIT BODY FORMED OF MULTIPLE MATRIX MATERIALS AND METHOD FOR MAKING THE SAME

(75) Inventor: Kumar T. Kembaiyan, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 11/250,097

(22) Filed: Oct. 12, 2005

(65) Prior Publication Data

US 2006/0032335 A1 Feb. 16, 2006

Related U.S. Application Data

(62) Division of application No. 10/454,924, filed on Jun. 5, 2003, now abandoned.

(51) Int. Cl.
*B21K 5/04* (2006.01)

(52) U.S. Cl. ..... 76/108.1; 76/108.2

(58) Field of Classification Search ..... 76/180.1, 76/180.2; 419/5, 4, 28, 9, 27; 175/393, 434
See application file for complete search history.

(56) References Cited

U.S. PATENT DOCUMENTS 3,471,921 A * 10/1969 Feenstra ..... 228/124.1
3,565,247 A 2/1971 Brochman
3,615,992 A 10/1971 Jeffries et al.
3,757,879 A * 9/1973 Wilder et al. ..... 175/434
4,351,401 A 9/1982 Fielder
4,499,795 A * 2/1985 Radtke ..... 76/108.2
4,682,987 A * 7/1987 Brady et al. ..... 51/293
4,694,919 A * 9/1987 Barr ..... 175/393
4,720,371 A * 1/1988 Shirley ..... 419/10
4,726,432 A 2/1988 Scott et al.
4,884,477 A * 12/1989 Smith et al. ..... 76/108.2
4,947,945 A 8/1990 Griffin
4,949,598 A 8/1990 Griffin
5,090,491 A 2/1992 Tibbitts et al.
5,099,935 A 3/1992 Anthon et al.
5,178,222 A 1/1993 Jones et al.
5,217,081 A 6/1993 Waldenström et al.
5,348,108 A 9/1994 Scott et al.
5,373,907 A * 12/1994 Weaver ..... 175/426
5,421,087 A * 6/1995 Newkirk et al. ..... 29/897.2
5,433,280 A 7/1995 Smith
5,441,121 A 8/1995 Tibbitts (Continued)

FOREIGN PATENT DOCUMENTS

JP 2091141 3/1990

(Continued)

OTHER PUBLICATIONS

German, R.M., "Powder Metallurgy Science", Second Edition, Copyright 1984, 1994, pp. 274-275.

*Primary Examiner* — Robert Scruggs
(74) *Attorney, Agent, or Firm* — Christie, Parker & Hale, LLP

(57) ABSTRACT

Drill bit bodies are provided having one portion formed of one composition and a further portion formed of a different composition. The different compositions provide different functional properties to respective portions of the drill bit body. Methods for forming such drill bit bodies are also provided.

26 Claims, 5 Drawing Sheets

U.S. PATENT DOCUMENTS

| | | | | |
|---|---|---|---|---|
| 5,500,289 | A | 3/1996 | Gavish | |
| 5,544,550 | A | 8/1996 | Smith | |
| 5,615,747 | A | 4/1997 | Vail, III | |
| 5,737,980 | A | 4/1998 | Keith et al. | |
| 5,765,095 | A | 6/1998 | Flak et al. | |
| 5,766,394 | A | 6/1998 | Anderson et al. | |
| 5,829,539 | A * | 11/1998 | Newton et al. | 175/393 |
| 5,839,329 | A | 11/1998 | Smith et al. | |
| 5,957,006 | A | 9/1999 | Smith | |
| 5,967,248 | A | 10/1999 | Drake et al. | |
| 6,073,518 | A * | 6/2000 | Chow et al. | 76/108.2 |
| 6,135,218 | A | 10/2000 | Deane et al. | |
| 6,148,936 | A | 11/2000 | Evans et al. | |
| 6,200,514 | B1 | 3/2001 | Meister | |
| 6,209,420 | B1 * | 4/2001 | Butcher et al. | 76/108.2 |
| 6,260,636 | B1 | 7/2001 | Cooley et al. | |
| 6,284,014 | B1 | 9/2001 | Carden | |
| 6,287,360 | B1 * | 9/2001 | Kembaiyan et al. | 75/240 |
| 6,360,832 | B1 | 3/2002 | Overstreet et al. | |
| 6,361,873 | B1 * | 3/2002 | Yong et al. | 428/469 |
| 6,394,202 | B2 | 5/2002 | Truax et al. | |
| 6,454,030 | B1 | 9/2002 | Findley et al. | |
| 6,461,401 | B1 | 10/2002 | Kembaiyan et al. | |
| 6,461,563 | B1 | 10/2002 | Lim et al. | |
| 6,564,884 | B2 | 5/2003 | Bird | |
| 6,655,481 | B2 | 12/2003 | Findley et al. | |
| 6,772,849 | B2 | 8/2004 | Oldham et al. | |
| 6,786,288 | B2 | 9/2004 | Singh | |
| 2002/0073803 | A1 | 6/2002 | Narasimhan et al. | |
| 2002/0110474 | A1 | 8/2002 | Sreshta et al. | |
| 2002/0125048 | A1 * | 9/2002 | Traux et al. | 175/434 |
| 2002/0175006 | A1 | 11/2002 | Findley et al. | |
| 2003/0111273 | A1 * | 6/2003 | Richert et al. | 175/426 |
| 2004/0244540 | A1 * | 12/2004 | Oldham et al. | 76/108.2 |
| 2004/0245022 | A1 * | 12/2004 | Izaguirre et al. | 175/374 |
| 2008/0127781 | A1 | 6/2008 | Ladi et al. | |

FOREIGN PATENT DOCUMENTS

| | | |
|---|---|---|
| JP | 05-093206 | 4/1993 |
| JP | 5148463 | 6/1993 |

* cited by examiner

BIT BODY FORMED OF MULTIPLE MATRIX MATERIALS AND METHOD FOR MAKING THE SAME

CROSS-REFERENCE TO RELATED APPLICATION(S)

This application is a divisional application of U.S. application Ser. No. 10/454,924, filed on Jun. 5, 2003 now abandoned, which is related to co-pending U.S. patent application Ser. No. 10/455,217, filed on Jun. 5, 2003, and co-pending U.S. application Ser. No. 10/455,281, filed on Jun. 5, 2003, the contents of each of which are hereby fully incorporated by reference.

BACKGROUND OF THE INVENTION

Various types and shapes of earth boring bits are used in various applications in today's earth drilling industry. The earth boring bits have bit bodies which include various features such as a core, blades, and pockets that extend into the bit body. Depending on the application, the drill bits may contain cutting elements such as polycrystalline diamond cutters (PDCs) and therefore be called PDC bits. Other bits have diamonds impregnated into the bit bodies for drilling through earthen formations. Such bits may also contain hot-pressed cutting elements called Grit hot-pressed inserts (GHIs). The cutting elements are received within the bit body pockets and are typically bonded to the bit body by brazing to the inner surfaces of the pockets. Bit bodies are typically made either from steel or from a tungsten carbide matrix. Bits made from the tungsten carbide matrix typically include a separately formed reinforcing member made of steel, and which is bonded to the matrix. The reinforcing member is positioned in the core section of the bit body and protrudes from the bit body.

The matrix bit body is typically formed of a single, relatively homogenous composition throughout the bit body. The single composition may constitute either a single matrix material such as tungsten carbide or a mixture of matrix materials such as different forms of tungsten carbide. The matrix material or mixture thereof, is commonly bonded into solid form by fusing a metallic binder material and the matrix material or mixture.

The drill bit formation process typically includes placing a matrix powder in a mold. The mold is commonly formed of graphite and may be machined into various suitable shapes. Displacements are typically added to the mold to define the pockets. The matrix powder may be a powder of a single matrix material such as tungsten carbide, or it may be a mixture of more than one matrix material such as different forms of tungsten carbide. The matrix powder may include further components such as metal additives. Metallic binder material is then typically placed over the matrix powder. The components within the mold are then heated in a furnace to the flow or infiltration temperature of the binder material at which the melted binder material infiltrates the tungsten carbide or other matrix material. This heating process is commonly referred to as sintering or liquid phase sintering. The infiltration process which occurs during sintering, bonds the grains of matrix material to each other and to the other components to form a solid bit body that is relatively homogenous throughout. The sintering process also causes the matrix material to bond to other structures that it contacts, such as a metallic blank which may be suspended within the mold to produce the aforementioned reinforcing member. After formation of the bit body, a protruding section of the metallic blank may be welded to a second component called an upper section. The upper section typically has a tapered portion that is threaded onto a drilling string.

The bit body typically includes blades which support the PDCs or GHIs which, in turn, perform the cutting operation. The blades may take on various shapes and may be reinforced with natural or synthetic diamonds formed on their respective surfaces, or they may be impregnated with diamond crystals throughout.

The drill bit body is typically formed to include cavities, commonly referred to as pockets, that extend into the bit body. The pockets which receive the cutting elements, are generally formed in the blade regions of the bit body.

The matrix material or materials determine the mechanical properties of the bit body. These mechanical properties include, but are not limited to, transverse rupture strength (TRS), toughness (resistance to impact-type fracture), hardness, wear resistance (including resistance to erosion from rapidly flowing drilling fluid and abrasion from rock formations), steel bond strength between the matrix material and steel reinforcing elements, such as a steel blank, and strength of the bond to the cutting elements, i.e., braze strength, between the finished body material and the PDC insert, GHI, or other cutting element. Abrasion resistance represents another such mechanical property.

The mechanical properties of the formed drill bit body may also be affected by the binder material used as well as the presence of diamond crystals impregnated within the bit body.

According to conventional drill bit manufacturing, a single matrix powder is selected in conjunction with the binder material, to provide desired mechanical properties to the bit body. The single matrix powder is packed throughout the mold to form a bit body having the same mechanical properties throughout. It would, however, be desirable to optimize the overall structure of the drill bit body by providing different mechanical properties to different portions of the drill bit body, in essence tailoring the bit body. For example, wear resistance is especially desirable at regions around the cutting elements and throughout the outer surface of the bit body, high strength and toughness are especially desirable at the bit blades and throughout the bulk of the bit body, superior braze strength is desirable in the pockets to which cutting inserts are brazed, and steel bond strength is desirable in the core region which is bonded to the steel blank. According to the conventional art, the choice of the single matrix powder represents a compromise, as it must be chosen to produce one of the properties that are desirable in one region, generally at the expense of another property or properties that may be desirable in another region.

It is therefore a shortcoming of the conventional art that a drill bit cannot be formed to include different desirable mechanical properties in different regions of the drill bit body. The present invention addresses these shortcomings.

SUMMARY OF THE INVENTION

The present invention is directed to a solid structural body, such as a drill bit body, that is formed of different matrix materials and is optimized to include different functional properties in different spatial locations. The present invention also provides methods for forming such a structural body.

In an exemplary embodiment, the present invention is directed to a drill bit body. The drill bit body is a solid structural body having a portion formed of a first composition and a further portion formed of a second composition. The first composition differs from the second composition. The portion may be the core, a blade, or the liner of a cavity extending into said solid structural body for receiving a cutting element therein. The first composition may consist primarily of a first matrix material and the second composition primarily of a second matrix material, the first matrix material being different from the second matrix material. The first and second compositions provide different functional properties to respective portions of the bit body.

In another exemplary embodiment of the invention, a method for forming such a drill bit body is provided. The method includes providing a mold and packing or filling at least part of the mold with a first matrix powder and a second matrix powder to produce a drill bit body having a portion formed of the first matrix powder and a further portion formed of the second matrix powder. The first matrix powder differs from the second matrix powder, and the portion may be the core, a blade or the liner of a cavity extending into the drill bit body for receiving a cutting element.

BRIEF DESCRIPTION OF THE DRAWINGS

The invention is best understood from the following detailed description when read in conjunction with the accompanying drawings. It is emphasized that, according to common practice, the various features of the drawing are not to scale. On the contrary, the dimensions of the various features may be arbitrarily expanded or reduced for clarity. Like numbers denote like features throughout the specification and drawings. Included are the following figures.

DETAILED DESCRIPTION OF THE INVENTION

The present invention provides a solid structural body of matrix material, such as a drill bit body, in which a feature of the bit body is formed from a matrix powder that is different from the matrix powder used to form other portions of the bit body. The feature may be the core, blades, or teeth of the bit body, the linings of a pocket that extends into the bit body for receiving cutting elements or surface portions adjacent the pocket. The different matrix powders produce different compositions that provide different functional properties. The present invention also provides a method for forming the bit body by packing a mold using different matrix powders in different portions of the mold.

Figure 1:
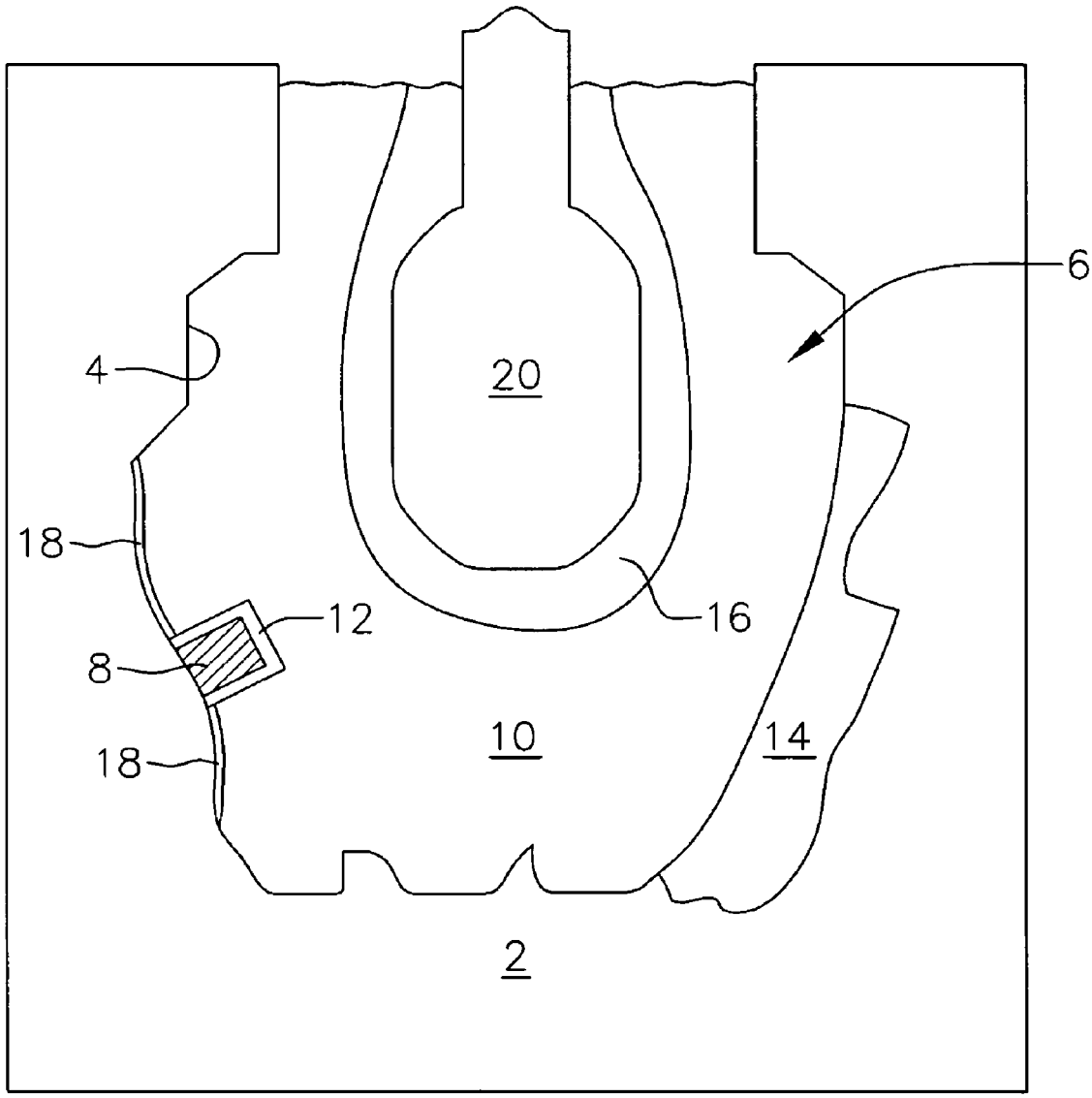
FIG. 1 is a cross-sectional view of a mold packed with materials for forming a bit body according to an exemplary embodiment of the present invention.

FIG. 1 is a cross-sectional view showing an exemplary mold packed with different matrix powders in different regions according to the present invention. Mold 2 is shaped to form a drill bit body. Inner surfaces 4 of mold 2 define the shape of the bit body. In the illustrated embodiment, the arrangement also includes displacement 8 which will form a cavity that extends into the formed drill bit body. Interior 6 of mold 2 is packed with multiple matrix powders including at least two matrix powders that differ from one another. The illustrated embodiment shows matrix powders 10, 12, 14, 16 and 18 disposed in various portions of interior 6 of mold 2 to produce different compositions in respective regions of the formed bit body. Matrix powders 10, 12, 14, 16 and 18 may each produce a particular feature in the formed bit body. In one exemplary embodiment, matrix powders 12, 14, 16 and 18 each differ from one another and from matrix powder 10. According to this embodiment, each of matrix powders 10, 14, 16 and 18 produce different compositions with associated, different functional properties, in the respective portions of the bit body that will be formed from the components disposed within mold 2. In another exemplary embodiment, only matrix powder 12 differs from matrix powders 10, 14, 16 and 18 which are the same. In another exemplary embodiment, only matrix powder 14 differs from matrix powders 10, 12, 16 and 18 which are the same. In yet another exemplary embodiment, only matrix powder 16 differs from matrix powders 10, 14, 16 and 18 which are the same. In still another exemplary embodiment, only matrix powder 18 differs from matrix powders 10, 12, 14 and 16 which are the same. In a further exemplary embodiment, matrix powders 12 and 18 differ from each other and from matrix powders 10, 14 and 16 which are the same. Alternatively stated, each of matrix powders 10, 12, 14, 16 and 18 will differ from one or more of the other matrix powders 10, 12, 14, 16 and 18 in various exemplary embodiments. More than five distinct matrix powders may be used in other exemplary embodiments and the distinct matrix powders may be disposed in various locations in the mold.

Each of matrix powders 10, 14, 16, and 18 consists of at least one matrix material such as tungsten carbide, and an optional metal additive or additives. Cobalt (Co), iron (Fe), nickel (Ni), or other transition metals are suitable metal additives. The metal additives may be present in various weight percentages within the particular matrix powder. One or more metal additives may be used. In an exemplary embodiment, each metal additive may be present at a weight percentage of up to 10% by weight and the total weight percentage of all metal additives may be up to 15% by weight.

Various suitable materials may be used as matrix materials. In one exemplary embodiment, the matrix material may be formed of tungsten carbide, WC. More specifically, the matrix material may be a particular type of tungsten carbide such as macro-crystalline tungsten carbide, cast tungsten carbide, carburized tungsten carbide or sintered tungsten carbide. The sintered tungsten carbide may be crushed or pelletized. In another exemplary embodiment, the matrix powder may include two or more matrix materials. For example, the matrix powder may include a mixture of two or more of the aforementioned types of WC. The two or more types of matrix materials may be combined in various weight proportions. In other exemplary embodiments, materials other than tungsten carbide may be the matrix material or may form part of the matrix material included in the matrix powder. As such, one matrix powder may differ from another matrix powder by having one or more of the above-described attributes being different.

Furthermore, one matrix powder may differ from another matrix powder only in particle size. Similarly, one matrix powder may differ from another matrix powder because a component included in both matrix powders has different particle sizes in the two matrix powders. The "particle size" may be the average particle size of the overall matrix powder or component, or it may represent the particle size distribution within the overall matrix powder or component. Matrix powders will differ from one another if a particular component, i.e. a matrix material and/or metal additive, is included in each of the matrix powders but includes different average particle sizes or different particle size distributions. Similarly, matrix powders will differ from one another if they include different weight proportions of components having different particle sizes. In addition, the matrix powders may include diamond crystals, also known as diamond grit, in various concentrations and having various particle sizes.

As shown in FIG. 1, the present invention provides for packing a mold such as mold 2, with different matrix powders in different spatial locations to form a drill bit body. Matrix powders 10, 12, 14, 16 and 18 are disposed in different locations to form different features in the formed bit body. For example, in the illustrated embodiment matrix powder 14 forms a blade, matrix powder 12 forms the liner of a cavity, or pocket, formed to extend into the bit body, and matrix powder 18 forms the surface of the bit body, more particularly, the portion of the surface of the formed bit body that is adjacent to the pocket. Matrix powder 10 forms the greatest portion of the bit body. Matrix powder 16 may form the core region which interfaces with metallic blank 20 which is disposed within mold 2. Metallic blank 20 may be formed of steel or other suitable materials and is suspended within mold 2 prior to or during the mold packing process. The liner of the cavity or pocket is a surface defining the cavity or pocket.

The different matrix powders may be packed into the discrete regions within the mold as illustrated in FIG. 1, using conventional packing techniques. In one exemplary embodiment, organic or other tapes may be used to separate the different matrix powders from each other. In other exemplary embodiments, other techniques for packing the mold with different powders in different spatial locations or regions, may be used.

After the multiple matrix powders are packed into mold 2, a binder material or materials may be added over the packed mold, and the arrangement sintered. That is, a heating process is carried out to elevate the temperature of mold 2 and the components in interior 6 of mold 2 and to cause the binder materials, usually copper or nickel based alloys (not shown) to infiltrate and cement the matrix powders. By infiltration, it is meant that the molten binder material flows through the spaces between the matrix material grains by means of capillary action. More particularly, the infiltration process bonds the grains of the matrix material within the matrix powder to each other to solidify the components within the mold to produce a solid bit body, and also bonds the matrix material to other structures that it contacts. For example, the infiltration process also causes the interfacial portion of matrix powder 16 to bond to metallic blank 20. Conventional sintering processes are available and may be used.

Each of the matrix powders illustrated in FIG. 1 produces a corresponding composition in the solidified bit body produced by the sintering process. The compositions may vary by including different matrix materials, different combinations of matrix materials or combinations of different weight percentages of matrix materials. Furthermore, the compositions may vary by including different metal additives, different combinations of metal additives, or metal additives present at different weight percentages. Moreover, the compositions may vary by being formed from matrix powders or components of matrix powders having different average particle sizes and/or different particle size distributions.

Each of the matrix powders illustrated in FIG. 1 forms a composition that provides a particular functional property or set of functional properties to the portion of the solid drill bit body that it forms. These functional properties include, but are not limited to a desirable degree of transverse rupture strength (TRS), a desirable degree of toughness (resistance to impact-type fracture), a desirable degree of wear resistance (including resistance to erosion from rapidly flowing drilling fluid and abrasion from rock formations), a desirable degree of hardness, a desirable degree of abrasion resistance, a desirable degree of steel bond strength between the matrix material and steel reinforcing elements such as steel blank 20, and a desirable degree of braze strength between the finished body material and a PCD insert, GHI insert, or other cutting element brazed to the bit body. By "functional property", it is meant that the mechanical property of interest, is exhibited to a degree such that the portion of the solid drill bit body is considered to demonstrate a degree of the mechanical property that is desirable for its application.

One exemplary matrix powder may consist of cast tungsten carbide at 30% by weight, carburized tungsten carbide at 62% by weight, and nickel powder as a metal additive at 8% by weight. The exemplary matrix powder may include an overall particle size distribution as follows: 2% wt. of 80 mesh particle size (177 μm average particle size); 14% wt. of 120 mesh particle size (125 μm average particle size); 19% wt. of 170 mesh particle size (88 μm average particle size); 20% wt. of 230 mesh particle size (63 μm average particle size); 14% wt. of 325 mesh particle size (44 μm average particle size); and 33% wt. of 400 mesh particle size (30 μm average particle size). In an exemplary embodiment, a solid bit body formed by this exemplary matrix powder is characterized as having a toughness of about 32 in/lb., a braze push-out load of about 18,000 pounds, a transverse-rupture strength (TRS) of 140 ksi, and a steel bond push-out load of about 70,000 pounds.

Another exemplary matrix powder may consist of carburized tungsten carbide at 70% by weight and having a particle size range of 20-60 μm; cast tungsten carbide with a particle size range of 30-150 μm at 20% by weight; and, cast tungsten carbide with a particle size range of 5-20 μm at 10% by weight. This exemplary matrix powder is solidified to form a solid bit body that exhibits a braze push-out load of about 22,300 pounds. This represents an 11% to 24% improvement over a typical braze push-out load of 18,000 to 20,000 pounds.

Other matrix powders may be used in other exemplary embodiments. The various matrix powders may include different components at various weight percentages and the matrix powders and the components within the matrix powders may include different average particle sizes and various particle size distribution ranges.

Figure 2:
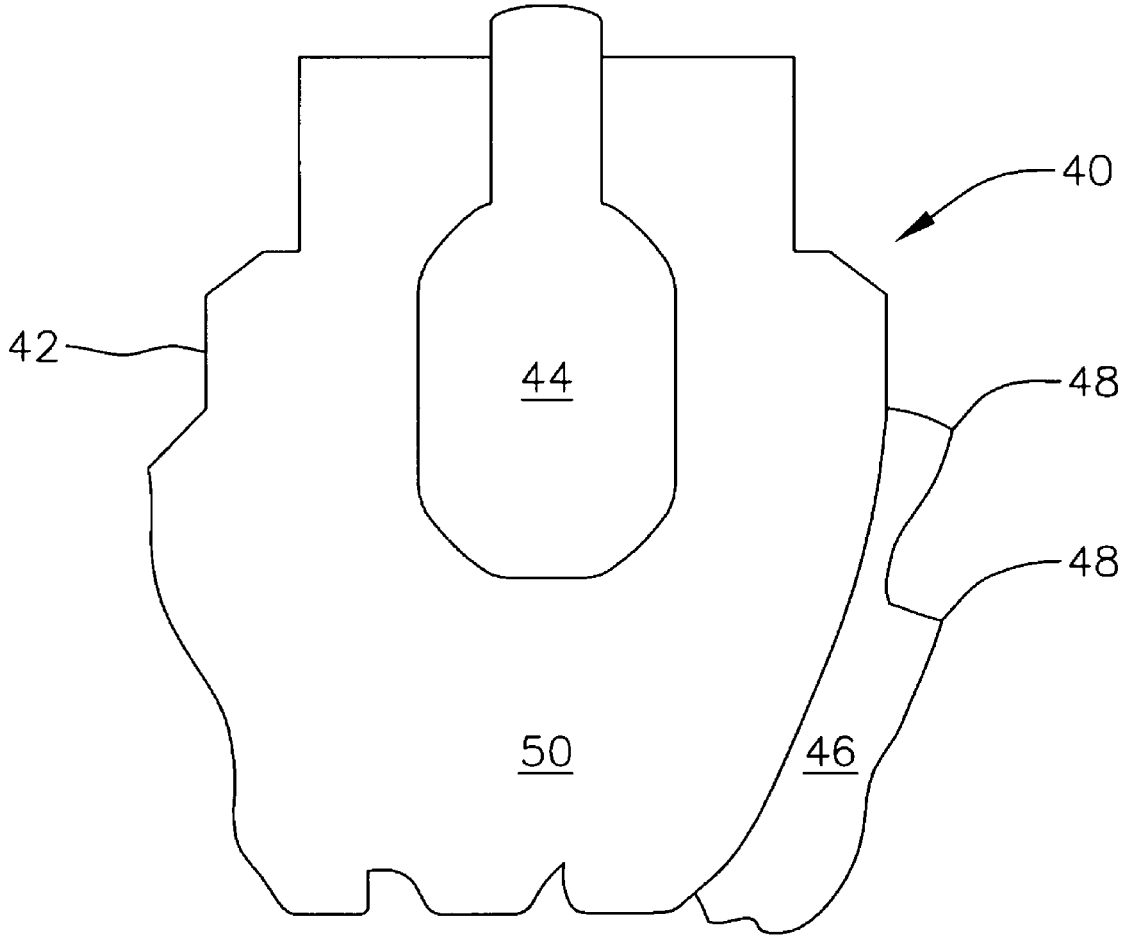
FIG. 2 is a cross-sectional view of an exemplary bit body of the present invention.
Figure 3:
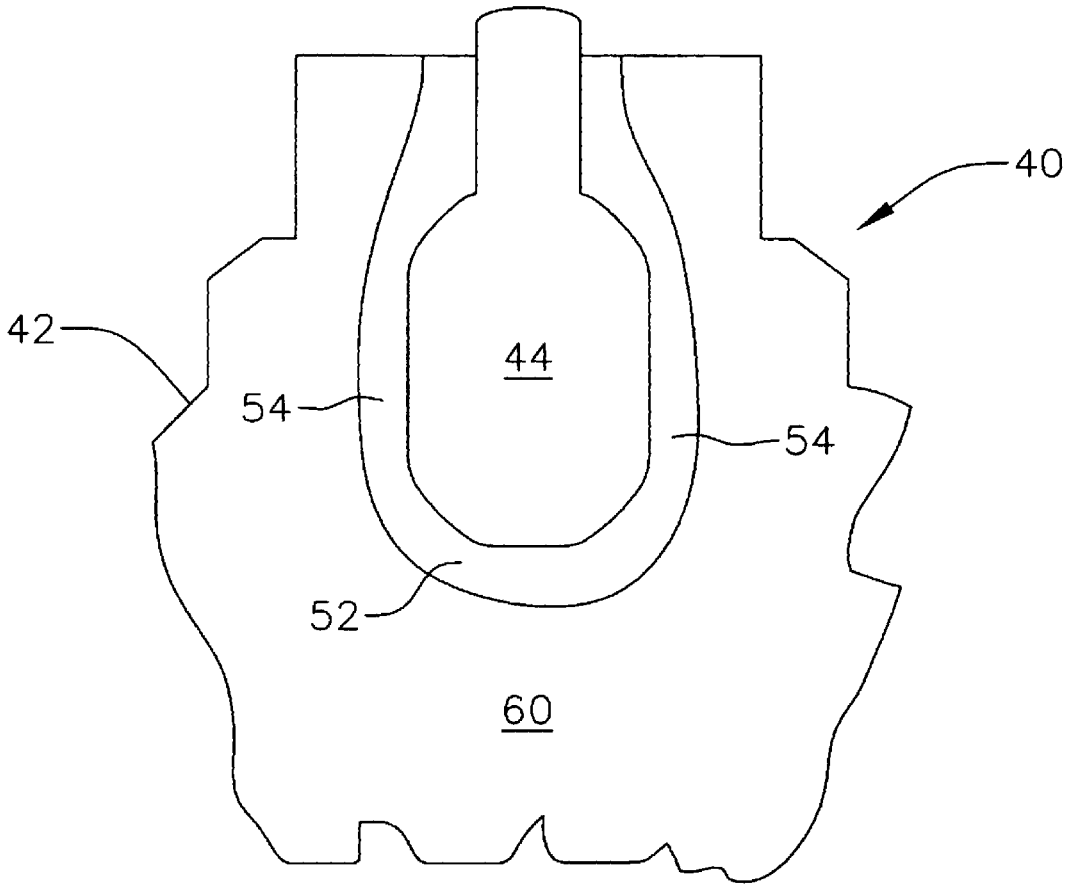
FIG. 3 is a cross-sectional view of another exemplary bit body of the present invention.
Figure 4:
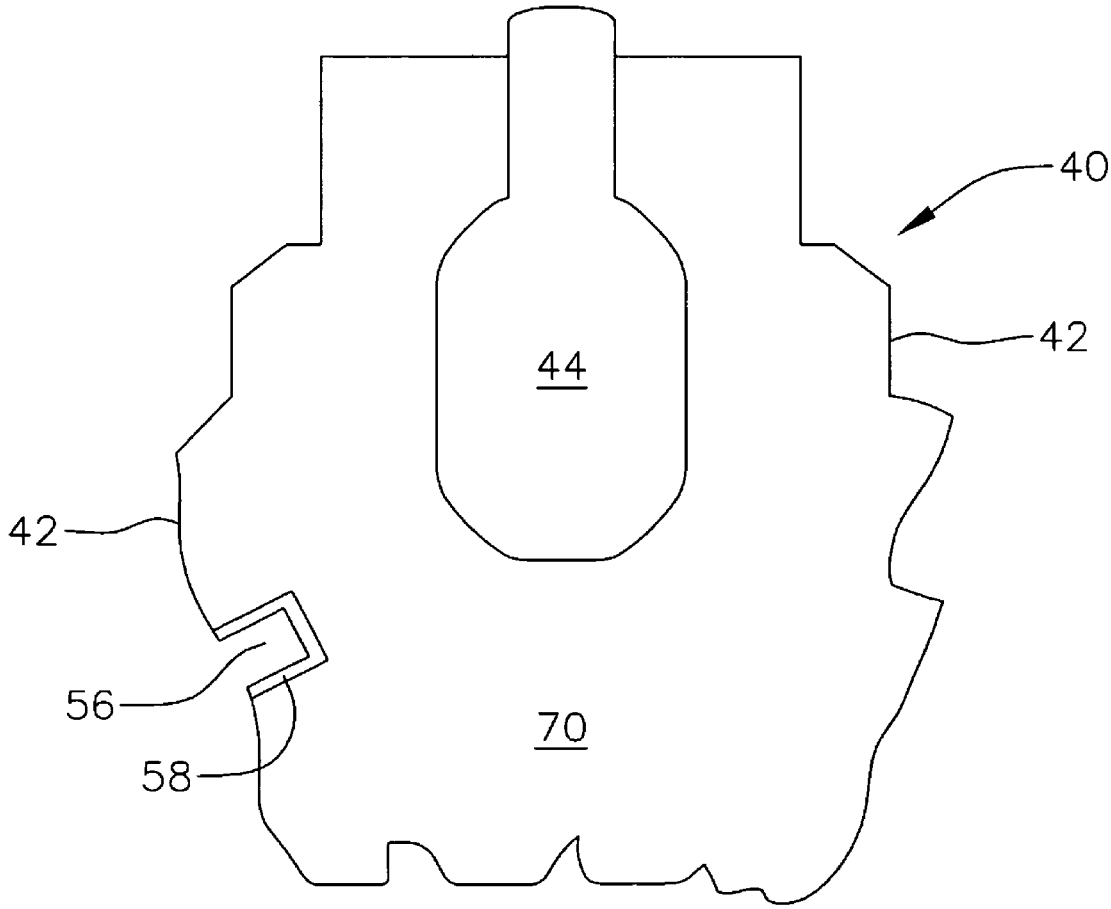
FIG. 4 is a cross-sectional view of a further exemplary embodiment bit body of the present invention.

Each of FIGS. 2-4 illustrates a cross-sectional view of an exemplary embodiment of a solid drill bit body bonded to a steel blank and formed according to an exemplary embodiment of the present invention.

FIG. 2 illustrates a cross-sectional view of drill bit body 40. Exemplary drill bit body 40 is a solid structural body defined by outer surfaces 42 and is bonded to metallic blank 44 upon formation and solidification. In the illustrated embodiment, drill bit body 40 includes blade 48 formed of first composition 46 and other portions of drill bit body 40 formed of second composition 50. First composition 46 and second composition 50 are formed from different matrix powders and may vary from each other as described above. Furthermore, first composition 46 and second composition 50 provide different functional properties or sets of functional properties, to the respective portion of the solid bit body that they form. First composition 46 may correspond to first matrix powder 14 as shown in FIG. 1, and second composition 50 may correspond to matrix powders 10, 12, 16 and 18 in an exemplary embodiment in which matrix powders 10, 12, 16 and 18 are the same. First composition 46 includes a first matrix material as a primary component thereof and second composition 50 includes a second matrix material as a primary component thereof. In one embodiment, the first matrix material differs from the second matrix material. Since first composition 46 forms the feature of blade 48, the matrix powder chosen to form first composition 46 may therefore be chosen to provide high strength and toughness in an exemplary embodiment.

FIG. 3 illustrates another exemplary bit body formed according to the present invention. Drill bit body 40 includes first composition 52 and second composition 60. First composition 52 and second composition 60 are formed from different matrix powders and may vary from one another in any of the manners described above. Furthermore, first composition 52 and second composition 60 provide different functional properties or sets of functional properties, to the portion of the solid bit body that they form. First composition 52 essentially forms the feature of the portion of core region 54 that forms an interface with steel blank 44. First composition 52 may correspond to first matrix powder 16 such as shown in FIG. 1, and second composition 60 may correspond to matrix powders 10, 12, 14 and 18, in an exemplary embodiment in which matrix powders 10, 12, 14 and 18 are the same. In an exemplary embodiment, first composition 52 may provide superior steel bond strength as bit body 40 is bonded to steel blank 44 in the core region 54. In an exemplary embodiment, nickel may be included within first matrix powder 16 shown in FIG. 1, to form first composition 46 to include enhanced bond strength.

FIG. 4 shows exemplary bit body 40 including pocket 56 that extends inwardly from surface 42 of bit body 40. Pocket 56 is lined with first composition 58 and other portions of bit body 40 are formed of second composition 70 in the illustrated embodiment. First composition 58 and second composition 70 are formed from different matrix powders and may vary from each other as described above. First composition 58 may correspond to first matrix powder 12 such as shown in FIG. 1, and second composition 70 may correspond to matrix powders 10, 14, 16 and 18 in an exemplary embodiment in which matrix powders 10, 14, 16 and 18 are the same. First composition 58 forms the feature of the liner of pocket 56 and the portion of bit body 40 to which a cutting element, inserted into pocket 56, will be brazed. First composition 58 and second composition 70 include different functional properties or different sets of functional properties. In an exemplary embodiment, first composition 58 is chosen to provide superior bond or braze strength between bit body 40 and the exemplary cutting element (not shown) brazed to the liner of pocket 56.

Figure 5:
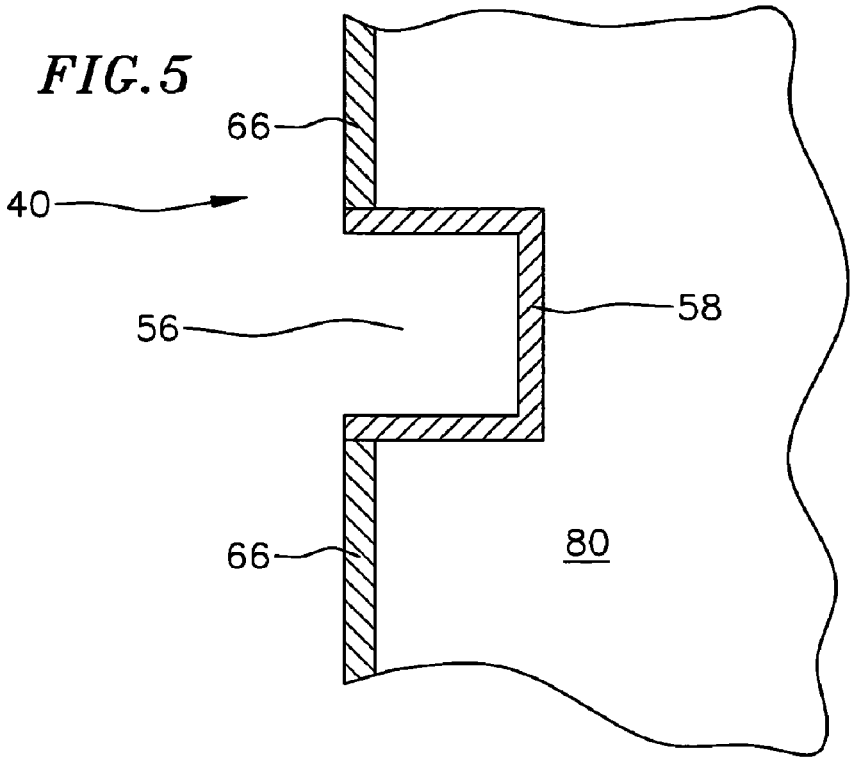
FIG. 5 is an enlarged cross-sectional view of a portion of a bit body formed according to an exemplary embodiment of the present invention.

FIG. 5 is a cross-sectional view of a portion of exemplary bit body 40. FIG. 5 shows first composition 58, second composition 66 and third composition 80. Each of first composition 58, second composition 66 and third composition 80 are formed from different matrix powders and may vary from each other as described above. In an exemplary embodiment, the matrix powders may differ by including different matrix materials. First composition 58 forms the feature of the liner of pocket 56 and second composition 66 forms the feature of the surface portion of bit body 40 that is adjacent pocket 56. Pocket 56 may advantageously be formed within a blade section of bit body 40. In an exemplary embodiment in which matrix powders 10, 14 and 16 of FIG. 1 are the same, first composition 58 may correspond to matrix powder 12, second composition 66 may correspond to matrix powder 18, and third composition 80 may correspond to bulk matrix powder 10 and matrix powders 14 and 16. First composition 58, second composition 66 and third composition 80 may provide different functional properties. For example, first composition 58 may provide superior braze strength and second composition 66 may provide superior wear resistance including resistance to erosion from rapidly flowing drilling fluid and abrasion from rock formations.

Figure 6:
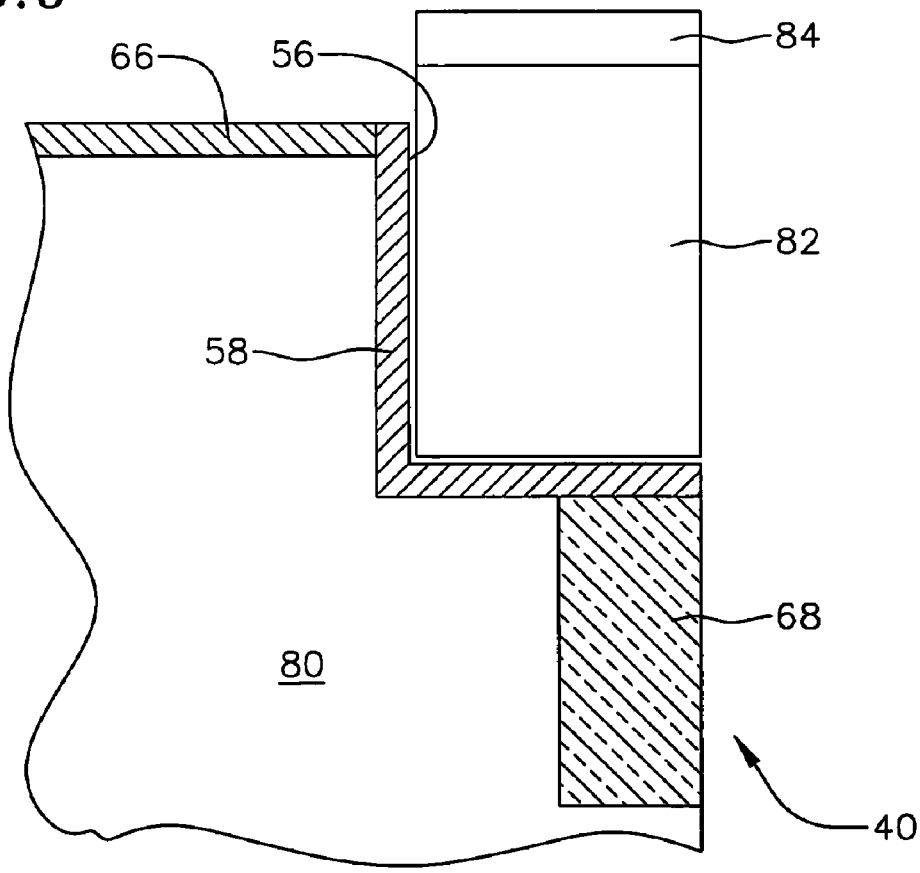
FIG. 6 is an enlarged cross-sectional view of a portion of a bit body formed according to another exemplary embodiment of the present invention.

FIG. 6 is a cross-sectional view of a portion of another exemplary bit body 40 that includes pocket 56. Cutting element 82 includes cutting table 84 and is received within pocket 56, which is formed within a blade section of bit body 40. FIG. 6 shows fourth composition 68, as well as previously described first composition 58, second composition 66 and third composition 80. Each of first composition 58, second composition 66, third composition 80, and fourth composition 68 are formed from different matrix powders and may vary from each other as described above. Fourth composition 68 forms the region behind pocket 56 and which is exposed to the earthen formation during cutting. First composition 58, second composition 66, third composition 80 and fourth composition 68 may provide different functional properties, for example, fourth composition 68 may advantageously provide superior strength, toughness and hardness. For example, fourth composition 68 may include diamond powder crystals therein.

It should be understood that the above-described and illustrated exemplary embodiments are exemplary and not restrictive of the present invention. According to other exemplary embodiments, the formed drill bit body may be formed using two or more different matrix powders disposed in various locations in the mold that will form various features in the formed bit body. Each of the different matrix powders corresponds to a different composition with different functional properties in the formed drill bit body.

The preceding merely illustrates the principles of the invention. It will thus be appreciated that those skilled in the art will be able to devise various arrangements which, although not The preceding merely illustrates the principles of the invention. It will thus be appreciated that those skilled in the art will be able to devise various arrangements which, although not explicitly described or shown herein, embody the principles of the invention and are included within its scope and spirit. Furthermore, all examples and conditional language recited herein are principally intended expressly to be only for pedagogical purposes and to aid in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and the functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of the present invention is embodied by the appended claims.

What is claimed is:

1. A method for forming a polycrystalline ultra hard material cutter bit having a body comprising:

providing a mold;

filling at least part of said mold with a first tungsten carbide matrix material to form at least a portion of a blade of said bit body, said at least a portion of a blade defining at least a portion of an outer surface of said blade;

filling at least part of said mold adjacent said first matrix material and interior of said first matrix material with a second tungsten carbide matrix material having a different functional property from the first matrix material to form at least a portion of a remainder of said blade interior of said at least a portion of an outer surface;

heating the mold with the matrix materials to form the bit body having a blade comprising said at least a portion of the blade having an outer surface formed from the first matrix material and an inner portion of the blade adjacent to the outer surface and radially interior of the outer surface formed from the second matrix material; and removing the formed bit body from the mold, said bit body comprising a pocket extending into a portion of the blade, said pocket having a surface for receiving said polycrystalline ultra hard material cutter, said surface comprising a section formed from the first matrix material and a section formed from the second tungsten carbide matrix material, wherein both sections are formed in said blade, wherein said first matrix material does not line an entire of said pocket surface, and wherein said at least a portion of the outer surface of the blade has higher wear resistance than said at least a portion of the remainder of the blade.

2. A method as recited in claim 1 wherein the first matrix material comprises diamond.

3. A method as recited in claim 1 further comprising filing at least part of said mold with a third matrix material for defining a liner lining said pocket surface, wherein said pocket comprises a base and a peripheral wall extending from the base, wherein the liner lines said base and said peripheral wall, wherein after heating the liner has better brazing properties than the at least said portion of the blade and wherein after heating the at least a portion of the blade has better wear resistance than said liner.

4. A method as recited in claim 1 further comprising:

determining desired functional properties for said at least a portion of the blade outer surface and said at least a portion of the remainder of the blade; and selecting the first matrix material and the second matrix material based on the desired functional properties.

5. A method as recited in claim 1 further comprising filling at least a part of said mold adjacent to the second matrix material with a third tungsten carbide matrix material, wherein the third matrix material is different from the first and the second matrix materials.

6. A method as recited in claim 5 wherein a tape is used to separate one of the matrix materials from another of the matrix materials.

7. A method as recited in claim 1 further comprising filling at least part of said mold with a third matrix material, different from the first matrix material and different from the second matrix material, to form at least a portion of a core of said bit body.

8. A method as recited in claim 7 further comprising:

determining desired functional properties for the at least a portion of the blade outer surface, the at least a portion of the remainder of the blade, and the at least a portion of the core; and selecting the first, second and third matrix materials based on the desired functional properties.

9. The method as in claim 1, wherein said first matrix material includes a first metal additive and said second matrix material includes a second metal additive, said first metal additive differing from said second metal additive.

10. The method as in claim 1, wherein said first matrix material includes a first type of tungsten carbide and said second matrix material includes a second type of tungsten carbide, said first type of tungsten carbide differing from said second type of tungsten carbide, each of said first type of tungsten carbide and said second type of tungsten carbide selected from the group consisting of carburized tungsten carbide, cast tungsten carbide, macro-crystalline tungsten carbide, crushed sintered tungsten carbide and pelletized sintered tungsten carbide.

11. The method as in claim 1, wherein said first matrix material includes a first average particle size and said second matrix material includes a second average particle size being different than said first average particle size.

12. The method as in claim 1, wherein said first matrix material includes a first particle size distribution and said second matrix material includes a second particle size distribution being different from said first particle size distribution.

13. The method as in claim 1, wherein said first matrix material includes a first mixture of more than one type of tungsten carbide matrix material and said second matrix material includes a second mixture of more than one type of tungsten carbide matrix material.

14. The method as in claim 1 further comprising placing a tape to separate the first matrix material from the second matrix material.

15. The method as recited in claim 1 further comprising attaching a polycrystalline diamond cutter to said pocket.

16. The method as recited in claim 1 wherein the first matrix material comprises cast tungsten carbide.

17. The method as recited in claim 16 wherein the second matrix material comprises cast tungsten carbide and carburized tungsten carbide.

18. The method as recited in claim 1 wherein the first matrix material comprises macro-crystalline tungsten carbide.

19. A method for forming a polycrystalline ultra hard material cutter bit having a body, the method comprising:

providing a mold;

providing a displacement in the mold;

filling at least part of said mold with a first tungsten carbide matrix material to form at least a portion of a blade of said bit body, said at least a portion of a blade defining at least a portion of an outer surface of said blade;

filling at least part of said mold adjacent said first matrix material and radially interior of said first material with a second matrix material, having a different functional property from the first matrix material to form at least a portion of a remainder of the blade;

placing a third matrix material over said displacement;

heating the mold with the matrix materials to form the bit body; and removing the formed bit body from the mold, said bit body comprising a pocket defined by said displacement and lined by a liner formed from said third matrix material, wherein said pocket comprises a base and a peripheral wall extending from the base, wherein said base and at least a portion of said peripheral wall is formed from said second matrix material, wherein another portion of the peripheral wall is formed from the first matrix material, wherein the liner lines said base and said peripheral wall, wherein said base and said at least a portion of the peripheral wall is not lined by said first matrix material, wherein said pocket extends into the blade for receiving a polycrystalline ultra hard material cutter, wherein said at least a portion of the blade outer surface has higher wear resistance than said at least a portion of the remainder of the blade, and wherein said liner has better brazing properties than the at least said portion of the blade outer surface and wherein after heating the at least a portion of the blade outer surface has better wear resistance than said liner.

20. A method as recited in claim 1 further comprising filling at least part of said mold adjacent the first matrix material with a third matrix material to form at least another portion of the blade defining at least another portion of the blade outer surface adjacent to said at least a portion of the outer surface of said blade, wherein said third matrix material has a different functional property from said first matrix material and from said second matrix material.

21. A method as recited in claim 20 wherein the third matrix material is tungsten carbide matrix material.

22. A method as recited in claim 1 further comprising placing at least part of a metallic blank into the mold prior to heating and wherein said formed bit body includes said blank.

23. A method as recited in claim 19 further comprising filling at least part of said mold adjacent the first matrix material with a fourth matrix material to form at least another portion of the blade defining at least another portion of the blade outer surface adjacent to said at least a portion of the outer surface of said blade, wherein said third matrix material has a different functional property from said first matrix material and from said second matrix material.

24. A method as recited in claim 23 wherein the fourth matrix material is tungsten carbide matrix material.

25. A method as recited in claim 19 further comprising placing at least part of a metallic blank into the mold prior to heating and wherein said formed bit body includes said blank.

26. A method as recited in claim 19 wherein the pocket base is formed on a portion of said bit body formed from the second matrix material.

* * * * *

UNITED STATES PATENT AND TRADEMARK OFFICE

CERTIFICATE OF CORRECTION

PATENT NO. : 8,109,177 B2
APPLICATION NO. : 11/250097
DATED : February 7, 2012
INVENTOR(S) : Kumar T. Kembaiyan It is certified that error appears in the above-identified patent and that said Letters Patent is hereby corrected as shown below:

In the Claims:

Column 9, Claim 3, line 25. Delete "filing"
Insert -- filling --

Signed and Sealed this
Tenth Day of July, 2012

David J. Kappos

David J. Kappos
*Director of the United States Patent and Trademark Office*